US010473392B2

(12) United States Patent
Cavagne et al.

(10) Patent No.: US 10,473,392 B2
(45) Date of Patent: Nov. 12, 2019

(54) COLUMN FOR SEPARATING AIR BY CRYOGENIC DISTILLATION, AIR SEPARATION DEVICE COMPRISING SUCH A COLUMN AND METHOD FOR PRODUCING SUCH A COLUMN

(71) Applicant: L'Air Liquide, Societe Anonyme pour l'Etude et l'Exploitation des Procedes Georges Claude, Paris (FR)

(72) Inventors: Patrice Cavagne, Le Perreux sur Marne (FR); Olivier De Cayeux, Nogent sur Marne (FR); Natacha Haik-Beraud, Champigny-sur-Marne (FR); Nathalie P. Schmitt, Schwalbach am Taunus (DE)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 399 days.

(21) Appl. No.: 15/117,564

(22) PCT Filed: Feb. 13, 2015

(86) PCT No.: PCT/FR2015/050355

§ 371 (c)(1),
(2) Date: Aug. 9, 2016

(87) PCT Pub. No.: WO2015/121593

PCT Pub. Date: Aug. 20, 2015

(65) Prior Publication Data

US 2017/0023296 A1 Jan. 26, 2017

(30) Foreign Application Priority Data

Feb. 14, 2014 (FR) ..... 14 51166

(51) Int. Cl.
*F25J 3/04* (2006.01)

(52) U.S. Cl.
CPC ..... *F25J 3/04678* (2013.01); *F25J 3/0489* (2013.01); *F25J 3/04412* (2013.01);
(Continued)

(58) Field of Classification Search
CPC .. F25J 3/04896; F25J 2290/10; F25J 3/04909; F25J 3/04412; F25J 3/04969
See application file for complete search history.

(56) References Cited

U.S. PATENT DOCUMENTS 4,784,677 A * 11/1988 Al-Chalabi ..... F25J 3/04412 23/293 R
5,224,351 A * 7/1993 Jeannot ..... B01D 3/008 165/166

(Continued)

FOREIGN PATENT DOCUMENTS

DE 42 24 068 9/1993
EP 0 664 144 7/1995

(Continued)

OTHER PUBLICATIONS

International Search Report and Written Opinion for PCT/FR2015/050355, dated Nov. 2, 2015.

*Primary Examiner* — Keith M Raymond
*Assistant Examiner* — Webeshet Mengesha
(74) *Attorney, Agent, or Firm* — Justin K. Murray

(57) ABSTRACT

The invention relates to a column for separating air by means of cryogenic distillation, said column comprising a shell and at least four distillation segments, including at least a first intermediate distillation segment of the low-pressure column, which is surrounded by an auxiliary shell around which a space is defined that is divided into a lower section and an upper section along the radius of the column, the intermediate segment(s) being located in an intermediate part of the low-pressure column, the capacity of the first intermediate segment being greater than that of at least one (Continued)

adjacent segment, and an opening being disposed in the shell between two adjacent segments, which opening can be sealed if the column is to form part of an argon production device.

2 Claims, 2 Drawing Sheets

(52) U.S. Cl.
CPC ..... *F25J 3/04896* (2013.01); *F25J 3/04909* (2013.01); *F25J 3/04921* (2013.01); *F25J 3/04969* (2013.01); *F25J 2290/10* (2013.01)

(56) References Cited

U.S. PATENT DOCUMENTS

| | | | | |
|---|---|---|---|---|
| 5,339,648 | A | 8/1994 | Lockett et al. | |
| 5,632,934 | A * | 5/1997 | Billingham | B01J 19/32 261/112.2 |
| 6,321,567 | B1 * | 11/2001 | Lockett | B01J 19/32 62/643 |
| 2008/0029381 | A1 | 2/2008 | Dubettier et al. | |
| 2008/0185350 | A1 * | 8/2008 | Remesat | B01D 43/00 210/774 |

FOREIGN PATENT DOCUMENTS

| | | |
|---|---|---|
| EP | 0 707 885 | 4/1996 |
| EP | 1 108 965 | 6/2001 |
| FR | 2 854 579 | 11/2004 |

* cited by examiner

COLUMN FOR SEPARATING AIR BY CRYOGENIC DISTILLATION, AIR SEPARATION DEVICE COMPRISING SUCH A COLUMN AND METHOD FOR PRODUCING SUCH A COLUMN

CROSS REFERENCE TO RELATED APPLICATIONS

This application is a § 371 of International PCT Application PCT/FR2015/050355, filed Feb. 13, 2015, which claims the benefit of FR1451166, filed Feb. 14, 2014, both of which are herein incorporated by reference in their entireties.

FIELD OF THE INVENTION

The present invention relates to a column for separating air by cryogenic distillation, an air separating device comprising such a column and a method for producing such a column

BACKGROUND OF THE INVENTION

It is sometimes necessary to change the designs of an air separating device during the design phase as a function of changing client requirements. For example, the client may decide that it needs to produce argon, even if the device has already been designed without providing for argon production or without an argon column.

One way of addressing this problem is to design the device with a column that is able to produce argon, but that discharges the argon-rich gas into the waste nitrogen if the argon is not required. It is also possible to increase the dimensions of the low-pressure column. These two solutions necessarily increase investment costs.

An air-distillation facility enabling argon production usually comprises a medium-pressure column, typically operating under approximately 6 bars absolute, surmounted by a low-pressure column typically operating slightly above atmospheric pressure and coupled to an impure-argon production column. An evaporator-condenser creates a heat-exchange relationship between the overhead vapor of the medium-pressure column, comprising substantially pure nitrogen, and the kettle liquid from the low-pressure column, comprising substantially pure oxygen.

The low-pressure column includes a distillation segment and, immediately above same, a first intermediate distillation segment, and several segments above the first intermediate distillation segment, usually two or three.

Each of the distillation segments is made of cross-corrugated structured packing blocks.

As is well known, a cross-corrugated packing block is made of a packet of corrugated plates each arranged in a substantially vertical plane and touching one another, each plate having a substantially rectangular shape. The plates are corrugated obliquely, and the direction of incline of the corrugations is inverted from one plate to the next. All of the plates are of the same height, while the length or horizontal dimension of same increases from a minimum value for an end plate to a maximum value for the middle plate, before decreasing to the same minimum value for the other end plate.

Each of the segments is a continuous packing segment, i.e. a segment comprising a direct stack of elementary blocks on one another with no intermediate fluid redistribution device, each elementary block being turned 90° about the axis of the column in relation to the two adjacent layers.

The first intermediate distillation segment, as described in EP-A-0664144, has a smaller section than the other segments and is therefore in the middle of the low-pressure column with an annular-section space between the edge of the segment and the main shell of the column. The column is designed such that the argon-rich vapor can be drawn off in this annular-section space beneath a baffle that divides the space into a lower section and a vertically upper section. This vapor is then fed into the argon column. The kettle liquid in the argon column is also returned to the lower section, where the most argon-rich vapor is drawn off. The vaporized rich liquid coming from the top condenser of the argon column is conveyed to the upper section of the space.

The first intermediate distillation segment is separated from adjacent segments by distributors.

Consequently, the gas extractions and feeds in the column that are related to argon production do not increase the height of the column.

The reduced diameter of this first intermediate distillation segment is possible without increasing the diameter of the column because this segment is not design critical. Indeed, a significant quantity of gas flows into the argon column and therefore does not pass through this segment.

If the facility is designed not to produce argon, this reduced-section segment is not installed, according to the prior art.

SUMMARY OF THE INVENTION

One of the objectives of the present invention is to provide a low-pressure column design for production with and without argon. The idea is to use a column with a first reduced-section intermediate distillation segment, with or without argon production, and to modify the density of the packing in this segment, with a lower density if argon production is not required and a higher density if argon production is required.

The invention makes it possible to use a standard model for the low-pressure column, with or without argon production. This makes it possible to standardize the architecture of the cold box, including the fluid supply lines. Delivery times to the client can therefore be reduced since it is possible to manufacture the column before deciding whether argon needs to be produced or not.

It is known to increase the capacity of a packing segment by changing the geometry of the packing, as described in document EP-A-0707885.

According to one objective of the invention, a column is provided for separating air by cryogenic distillation having one shell and at least four distillation segments, each segment comprising a stack of cross-corrugated structured packing blocks, each block comprising a packet of rectangular corrugated plates, at least a first intermediate distillation segment of the column being surrounded by an auxiliary shell in turn surrounded by a space divided into a lower section and an upper section in the radial direction of the column, the intermediate segment or segments being positioned in an intermediate portion of the column, characterized in that the capacity of the first intermediate segment is greater than the capacity of at least one adjacent segment, or the capacity of the other segments of the column, and in that second and third intermediate distillation segments are arranged such that, when in use, the second segment is above the first intermediate segment and the third intermediate segment is above the second intermediate segment, and comprising a first opening in the space between the first and second intermediate segments, a second opening in the space between the second and third intermediate segments and a third opening in the space above the third segment, the first, second and third openings being designed to be connected to a liquid input pipe, the first or the third opening being closed and the second opening being open.

According to another optional objective of the invention, the column includes:

- openings in the shell provided to link the upper section and the lower section to the outside of the column, said openings being closed,
- the packing in the first intermediate segment is at least 50 m2/m3 less dense than at least one of the adjacent segments,
- the geometry of the packing in the first intermediate segment is different to the geometry of at least one of the adjacent segments.

According to another objective of the invention, an air separating device is provided, including a medium-pressure column linked thermally to a low-pressure column as described above that does not include means for conveying a fluid from an intermediate level of the low-pressure column to another column to be separated.

According to another objective of the invention, a method is provided for producing a column of an air separating device in which a column is built with a main shell and several distillation segments are installed therein, each segment comprising a stack of cross-corrugated structured packing blocks, each block comprising a packet of rectangular corrugated plates, at least a first intermediate distillation segment of the low-pressure column being surrounded by an auxiliary shell in turn surrounded by a space divided into a lower section and an upper section in the radial direction of the column, the intermediate segment or segments being positioned in an intermediate portion of the low-pressure column, characterized in that i) if the column is designed to be part of a device not producing an argon-rich flow, packing is installed for the first intermediate segment, the packing being selected such that the capacity of the first intermediate segment is greater than the capacity of at least one adjacent segment or the capacity of the other segments of the column, and at least one reflux opening is formed in the main shell at a point between two adjacent segments, at a level between the first intermediate segment and the head of the column, and ii) if the column is designed to be part of a device producing an argon-rich flow, the reflux opening is blocked.

According to other optional aspects:

- at least one opening is formed in the main shell giving access to the lower section and/or to the upper section, and at least one opening is blocked if the column is designed to be part of a device not producing an argon-rich flow.
- at least one reflux opening is formed in the main shell at a point between two adjacent segments, at a level between the first segment and the head of the column, and the reflux opening is blocked if the column is designed to be part of a device not producing an argon-rich flow,
- at least one reflux opening is formed in the main shell at a point between two adjacent segments, at a level between the first segment and the head of the column, and the reflux opening is blocked if the column is designed to be part of a device producing an argon-rich flow.

The term "rich liquid" used here is a professional term that refers to a liquid that is oxygen-rich in comparison to air.

In general, it is useful to design a standard version of the medium-pressure column and the bottom of the low-pressure column (at least one segment), regardless of the products required, and to design the rest of the low-pressure column as a function of client requirements.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
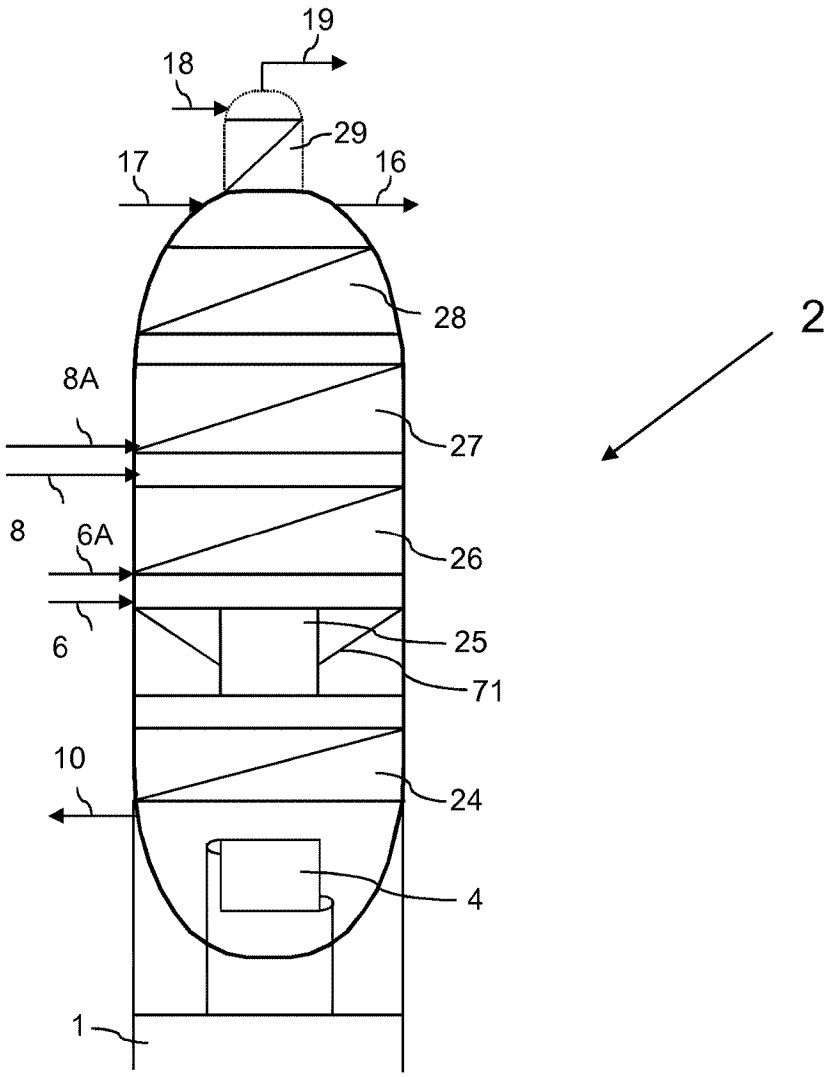
FIG. 1 represents a schematic diagram for an embodiment of the present invention.
Figure 2:
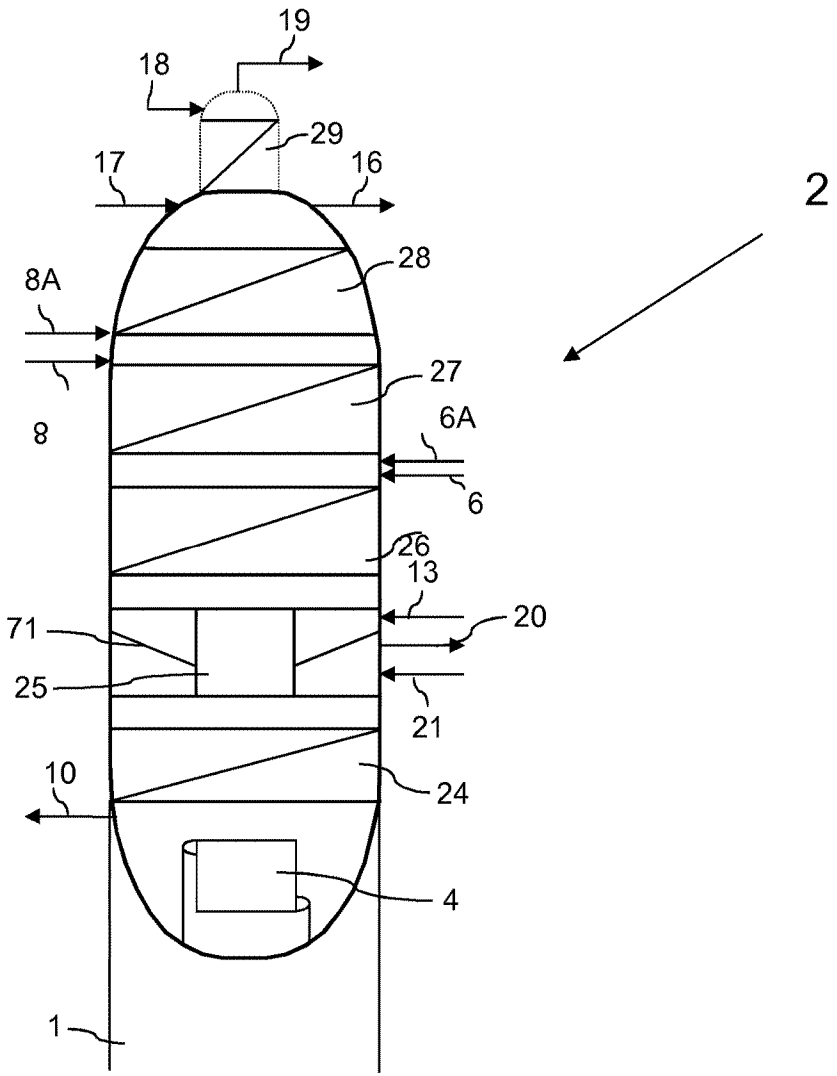
FIG. 2 represents a schematic diagram for an alternate embodiment of the present invention

Example embodiments of the invention are described below with reference to the attached drawings, in which:

FIG. 1 is a schematic diagram of a low-pressure column of an air distillation device according to the invention designed for use without argon production, FIG. 2 is a schematic diagram of a low-pressure column of an air distillation device according to the invention designed for use with argon production.

The air distillation facility, the low-pressure column of which is shown in FIG. 1, comprises a medium-pressure column 1, typically operating under approximately 6 bars absolute, surmounted by the low-pressure column 2 typically operating slightly above atmospheric pressure. It can be seen that there is no column for producing pure or impure argon. An evaporator-condenser 4 creates a heat-exchange relationship between the overhead vapor of the column 1, comprising substantially pure nitrogen, and the kettle liquid from the column 2, comprising substantially pure oxygen.

The column 1 receives the pressurized purified air to be separated and produces an oxygen-rich liquid flow and a nitrogen-rich liquid flow, which are both conveyed to the low-pressure column 2.

The very schematic illustration in FIG. 1 is essentially intended to show the fluid inputs/outputs in the facility, as well as the distillation segments defined by same.

The main shell of the low-pressure column 2 comprises six distillation segments, specifically:

- a lower distillation segment 24 between the base of the column with the liquid output 10 of same and the intermediate distillation segment 25,
- immediately above the segment 24 with a distributor (not shown) between the two, the first intermediate distillation segment 25 beneath the liquid input 6, the section of the first intermediate distillation segment being smaller than the section of the lower segment,
- a second intermediate distillation segment 26 between the first and third intermediate distillation segments,
- a third intermediate distillation segment 27 between the second intermediate distillation segment and an upper distillation segment 28,
- an upper distillation segment 28 between the third intermediate distillation segment and a minaret segment, the minaret segment 29, the section of which is smaller than the section of the upper distillation segment.

The section of the first intermediate distillation segment is smaller than the sections of the lower segment, upper segment and second and third intermediate segments. The segment 29 is shown using a dotted line since the presence of same is not essential.

The first intermediate segment 25 is a cylindrical body comprising packing surrounded by an auxiliary shell having a smaller diameter than the shell of the column. It is arranged inside the shell of the column and surrounded by an annular-section space delimited by the shell of the column and the auxiliary shell surrounding the packing. An annular sealing member 71 sealingly joins the shell of the column and the auxiliary shell, and the top of the segment 26 is separated from the distributor 29C by spacers 72.

Each of the distillation segments 23 to 29 is made of cross-corrugated structured packing blocks.

As is well known, a cross-corrugated packing block is made of a packet of corrugated plates each arranged in a substantially vertical plane and stuck to one another, each plate having a substantially rectangular shape. The plates are corrugated obliquely, and the direction of incline of the corrugations is inverted from one plate to the next. All of the plates are of the same height, while the length or horizontal dimension of same increases from a minimum value for an end plate to a maximum value for the middle plate, before decreasing to the same minimum value for the other end plate.

Each of the segments 23 to 29 is a continuous packing segment, i.e. a segment comprising a direct stack of elementary packs on one another with no intermediate fluid redistribution device, each elementary pack being turned 90° about the axis of the column in relation to the two adjacent layers. This is possible, despite the large height of certain segments, notably segments 23, 24 and 28, which may comprise respectively 40, 38 and 50 theoretical plates, on account of a number of features set out below.

The distillation segments 24 and 25 on one hand, 25 and 26 on the other, 26 and 27, 27 and 28, finally 28 and 29, are separated from one another by a distributor.

Although the low-pressure column is not designed to be connected to an argon-production column, it nonetheless contains the reduced-section segment 25, which is usually used for low-pressure columns supplying an argon-production column.

Although the packing used for the five segments 24 to 28 are identical in a low-pressure column feeding an argon-production column, the packing used for the first intermediate segment 25 is less dense than the packing in segments 24, 26, 27, 28 and possibly 29. The presence of the segment 29 is not essential.

This means that, when building the column, the decision regarding the packing capacity to be installed in the first intermediate segment can be taken very late, once the decision to produce argon or not to produce argon has been taken. The main shell and the external connections can be manufactured and the final usage to be made of the column 2 depends only on installation of the segment 25.

There are several different ways of altering the capacity of the segment 25. As proposed in document EP-A-0707885, it is possible to modify the edges of the packing segment in order to reduce the resistance to the gas flow in the lower and/or upper portion of the segment in relation to the inside of the segment.

It is also possible to select packing for the section 25 that is at least 50 $m^2/m^3$ less dense than for the segments 24 and 26. Consequently, the packing for the segment 25 can have an average density of 350 $m^2/m^3$ while the average density of the packing for the segments 24 and 26 is 500 $m^2/m^3$.

The objective is to select, if argon production is not required, a segment that has a higher flooding limit than if argon production is required. This difference in limit can be obtained in different ways, for example by selecting segments made of packing having different geometries, with or without a modified lower edge designed to reduce the resistance to gas flow, etc.

An input of rich liquid (oxygen-rich liquid) is provided for between the first and second intermediate segments. Upstream of the column, the liquid is expanded to partially vaporize, and a liquid flow 6 and a gas flow 6A are conveyed to the space between the two segments.

A liquefied-air input is provided between the second and third intermediate segments. Upstream of the column, the liquid is expanded to partially vaporize, and a liquid flow 8 and a gas flow 8A are conveyed to the space between the two segments.

A liquid nitrogen input 17 is provided between the upper segment 28 and the minaret segment 29 (optional), along with a liquid nitrogen input 18 at the top of the minaret segment. If there is no minaret, the liquid nitrogen is conveyed to the column head.

FIG. 1 shows the standard column 2 connected to operate as the low-pressure column of a double column without argon production.

If it is decided to use the same column 2 as the column feeding an argon-production column, the packing of the segment 25 will have the same density as the packing for segments 24, 26, 27, 28 and potentially 29 (for example 500 $m^2/m^3$). On the other hand, openings need to be formed in the column, as shown in FIG. 2.

The inside of the column is therefore identical to the inside of the column shown in FIG. 1, apart from the capacity of the segment 25. In the segment 25, a pipe is linked to the lower section beneath the barrier 71 to carry an argon-rich gas to the argon-separation column. The kettle liquid from this column goes to the lower section via the pipe 21. The vaporized rich liquid in the head condenser of the argon column goes through the pipe 13 to the upper section.

For reflux flows, the rich liquid 6 and the vaporized rich liquid 6A enter between the second and third intermediate segments 26, 27 and the liquefied air 8 and the vaporized liquefied air 8A enter between the third intermediate segment 27 and the upper segment 28. The nitrogen inputs are identical to the inputs in FIG. 1.

Consequently, before deciding whether or not the column 2 will be used to produce argon, openings can be formed in the first and second intermediate segments 25, 26, the second and third intermediate segments 26, 27 and between the third intermediate segment 27 and the upper segment 28. The column is then manufactured with openings enabling the subsequent connection of fluid pipes leading to or from the argon column, and enabling the connection to the medium-pressure column whether argon production is required or not.

A blind flange or another system is then used to close the unused inputs and outputs if argon production is not required, and to close other unused inputs and outputs if argon production is required.

If argon production is required, the opening between the first and second intermediate segments 25, 26 is blocked, the opening between the second and third intermediate segments 26, 27 enables the ingress of rich liquid and the opening between the third intermediate segment 27 and the other segment 28 enables the ingress of liquefied air.

If argon production is not required, the opening between the first and second intermediate segments 25, 26 enables the ingress of rich liquid, the opening between the second and third intermediate segments 26, 27 enables the ingress of liquefied air and the opening between the third intermediate segment 27 and the upper segments 28 is blocked.

There may nonetheless be differences between the column 2 designed for argon production and the column 2 not designed for argon production. In particular, the type or dimensions of the distributors may vary from one column to another.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A method for producing a lower pressure column of an air separating device that can be used for production with and without argon, wherein the lower pressure column is thermally connected with a higher pressure column, wherein the lower pressure column comprises:

a main outer shell;

a lower distillation segment, a first intermediate distillation segment disposed above the lower distillation segment, a second intermediate distillation segment disposed above the first intermediate distillation segment, a third intermediate distillation segment disposed above the second intermediate distillation segment, and an upper distillation segment disposed above the third intermediate distillation segment, wherein the first intermediate distillation segment is surrounded by an auxiliary shell, wherein the auxiliary shell has a radius that is smaller than the radius of the main outer shell, thereby forming an annular space between the auxiliary shell and the main outer shell;

an annular sealing member sealingly joining the auxiliary shell with the main outer shell, wherein the annular space comprises an upper section and a lower section;

a first liquid inlet disposed on the main outer shell between the first intermediate distillation segment and the second intermediate distillation segment;

a second liquid inlet disposed on the main outer shell between the second intermediate distillation segment and the third intermediate distillation segment;

a third liquid inlet disposed on the main outer shell above the third intermediate distillation segment and below the upper distillation segment;

a lower liquid inlet disposed on the main outer shell below the annular sealing member;

an upper gas inlet disposed on the main outer shell above the annular sealing member;

wherein the method comprises the step of:

determining whether the lower pressure column will be used in the production of argon; and (A) if the lower pressure column will be used for the production of argon, the method further comprises the steps of:

configuring the first intermediate distillation segment to have the same capacity as the second intermediate distillation segment, blocking the first liquid inlet, configuring the second liquid inlet to receive an oxygen-rich liquid from a bottom section of the higher pressure column, configuring the third liquid inlet to receive a liquid air stream, configuring the lower liquid inlet to receive a liquid from an argon column and introduce said liquid into the lower section of the annular space, configuring the upper gas inlet to receive a vaporized liquid from the argon column and introduce said vaporized liquid into the upper section of the annular space;

(B) if the lower pressure column will be used without the production of argon, the method further comprises the steps of:

configuring the first intermediate distillation section to have a higher capacity than the second intermediate distillation segment, blocking the lower liquid inlet, blocking the upper gas inlet, blocking the third liquid inlet, configuring the first liquid inlet to receive an oxygen-rich liquid from the bottom section of the higher pressure column, and configuring the second liquid inlet to receive the liquid air stream.

2. A lower pressure column of an air separating device that can be used for production with and without argon, wherein the lower pressure column is thermally connected with a higher pressure column when in operation, wherein the lower pressure column comprises:

a main outer shell;

a lower distillation segment, a first intermediate distillation segment disposed above the lower distillation segment, a second intermediate distillation segment disposed above the first intermediate distillation segment, a third intermediate distillation segment disposed above the second intermediate distillation segment, and an upper distillation segment disposed above the third intermediate distillation segment, wherein the first intermediate distillation segment is surrounded by an auxiliary shell, wherein the auxiliary shell has a radius that is smaller than the radius of the main outer shell, thereby forming an annular space between the auxiliary shell and the main outer shell;

an annular sealing member sealingly joining the auxiliary shell with the main outer shell, wherein the annular space comprises an upper section and a lower section;

a first liquid inlet disposed on the main outer shell between the first intermediate distillation segment and the second intermediate distillation segment;

a second liquid inlet disposed on the main outer shell between the second intermediate distillation segment and the third intermediate distillation segment;

a third liquid inlet disposed on the main outer shell above the third intermediate distillation segment and below the upper distillation segment;

a lower liquid inlet disposed on the main outer shell below the annular sealing member;

an upper gas inlet disposed on the main outer shell above the annular sealing member;

wherein a first packing of the first intermediate distillation section has a higher capacity as a second packing of the second intermediate distillation segment, wherein the lower liquid inlet is blocked, wherein the upper gas inlet is blocked, and wherein the third liquid inlet is blocked.

* * * * *